US012790656B2

(12) United States Patent
Minami et al.

(10) Patent No.: US 12,790,656 B2
(45) Date of Patent: Nov. 10, 2026

(54) HIGH STRENGTH STEEL SHEET AND METHOD FOR MANUFACTURING SAME AND MEMBER

(71) Applicant: JFE STEEL CORPORATION, Tokyo (JP)

(72) Inventors: Hidekazu Minami, Tokyo (JP); Masayasu Ueno, Tokyo (JP); Yuki Toji, Tokyo (JP); Yuji Tanaka, Tokyo (JP); Junya Tobata, Tokyo (JP); Kazuki Endoh, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 398 days.

(21) Appl. No.: 18/565,265

(22) PCT Filed: Mar. 28, 2022

(86) PCT No.: PCT/JP2022/015181
§ 371 (c)(1),
(2) Date: Nov. 29, 2023

(87) PCT Pub. No.: WO2022/270100
PCT Pub. Date: Dec. 29, 2022

(65) Prior Publication Data

US 2024/0368719 A1 Nov. 7, 2024

(30) Foreign Application Priority Data

Jun. 24, 2021 (JP) ..... 2021-105146

(51) Int. Cl.

| | |
|---|---|
| ***C21D 9/46*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C22C 38/02*** | (2006.01) |
| ***C22C 38/04*** | (2006.01) |
| ***C22C 38/06*** | (2006.01) |

(52) U.S. Cl.
CPC ..... *C21D 9/46* (2013.01); *C21D 8/02* (2013.01); *C21D 8/0226* (2013.01); *C21D 8/0236* (2013.01); *C21D 8/0273* (2013.01); *C21D 8/0278* (2013.01); *C22C 38/02* (2013.01); *C22C 38/04* (2013.01); *C22C 38/06* (2013.01); *C21D 2211/001* (2013.01); *C21D 2211/005* (2013.01)

(58) Field of Classification Search
CPC ..... C21D 2211/001; C21D 2211/002; C21D 2211/005; C21D 2211/008; C21D 8/02; C21D 8/0226; C21D 8/0236; C21D 8/0242; C21D 8/0273; C21D 8/0278; C21D 9/46; C22C 38/002; C22C 38/005; C22C 38/008; C22C 38/02; C22C 38/04; C22C 38/06; C22C 38/08; C22C 38/10; C22C 38/12; C22C 38/14; C22C 38/16; C22C 38/32; C22C 38/34; C22C 38/38; C22C 38/60; C22C 38/001; C22C 38/58
See application file for complete search history.

(56) References Cited

U.S. PATENT DOCUMENTS

| | | | |
|---|---|---|---|
| 2013/0087253 A1 | 4/2013 | Matsuda et al. | |
| 2017/0096723 A1 | 4/2017 | Kasuya et al. | |
| 2017/0191915 A1 | 7/2017 | Shirakami et al. | |
| 2019/0169729 A1 | 6/2019 | Yokoyama et al. | |
| 2019/0360081 A1 | 11/2019 | Minami et al. | |
| 2020/0040420 A1 | 2/2020 | Minami et al. | |
| 2021/0381075 A1* | 12/2021 | Minami | C22C 18/00 |
| 2024/0052464 A1 | 2/2024 | Kawasaki et al. | |

FOREIGN PATENT DOCUMENTS

| | | | |
|---|---|---|---|
| CN | 102884218 A | | 1/2013 |
| CN | 106103768 A | | 11/2016 |
| CN | 106461522 A | | 2/2017 |
| CN | 110291217 A | | 9/2019 |
| CN | 110312813 A | | 10/2019 |
| CN | 112207135 A | | 1/2021 |
| CN | 112823217 A | | 5/2021 |
| EP | 3822382 A1 | | 5/2021 |
| JP | 2009287102 | * | 12/2009 |
| JP | 2009287102 A | | 12/2009 |
| JP | 2013104081 A | | 5/2013 |
| JP | WO2020075394 | * | 4/2020 |
| JP | 6747612 B1 | | 8/2020 |

(Continued)

OTHER PUBLICATIONS

Aug. 22, 2024, the Extended European Search Report issued by the European Patent Office in the corresponding European Patent Application No. 22828019.4.

(Continued)

*Primary Examiner* — Nicholas A Wang
(74) *Attorney, Agent, or Firm* — KENJA IP LAW PC

(57) ABSTRACT

Provided is a high strength steel sheet with high stretch flangeability and high YR in the rolling direction as well as in the direction orthogonal to the rolling direction with TS of 1180 MPa or more. The high strength steel sheet has a prescribed chemical composition and steel microstructure. In particular, an average grain size of the hard phase is 5.3 μm or less, the volume fraction-carbon concentration ratio of retained austenite (γ) is 0.10 or more and 0.45 or less, and the integration degree of {112}<111> orientation is 1.0 or more.

16 Claims, No Drawings

(56) References Cited

FOREIGN PATENT DOCUMENTS

| | | | |
|---|---|---|---|
| KR | 1020210053324 | A | 5/2021 |
| WO | 2018011978 | A1 | 1/2018 |
| WO | 2020075394 | A1 | 4/2020 |
| WO | 2021070640 | A1 | 4/2021 |

OTHER PUBLICATIONS

Jun. 21, 2022, International Search Report issued in the International Patent Application No. PCT/JP2022/015181.

Aug. 22, 2025, Office Action issued by the Korean Intellectual Property Office in the corresponding Korean Patent Application No. 10-2023-7043455 with English language concise statement of relevance.

Jul. 31, 2025, Office Action issued by the China National Intellectual Property Administration in the corresponding Chinese Patent Application No. 202280035631.X with English language search report.

* cited by examiner

HIGH STRENGTH STEEL SHEET AND METHOD FOR MANUFACTURING SAME AND MEMBER

TECHNICAL FIELD

This disclosure relates to a high strength steel sheet, a method for manufacturing the same, and a member.

BACKGROUND

High strength steel sheets for automobiles are being developed to both reduce $CO_2$ emissions by reducing vehicle weight and improve crashworthiness. In addition, a series of new laws and regulations have been introduced. Therefore, for the purpose of increasing automotive body strength, the application of high strength steel sheets, especially high strength steel sheets with a tensile strength (hereinafter simply referred to as TS) of 1180 MPa or more, to major structural and reinforcing components that form the frame of the automobile cabin (hereinafter also referred to as automotive frame structural components, etc.) is increasing.

As a technique related to such high strength steel sheets, JP6747612B1 (PTL 1), for example, describes "a high strength steel sheet having a tensile strength of 1180 MPa or more, the high strength steel sheet having a chemical composition comprising, by mass %: C: 0.09% or more and 0.37% or less; Si: more than 0.70% and 2.00% or less; Mn: 2.60% or more and 3.60% or less; P: 0.001% or more and 0.100% or less; S: 0.0200% or less; Al: 0.010% or more and 1.000% or less; and N: 0.0100% or less; and with the balance being Fe and incidental impurities, wherein the steel sheet has a steel structure in which an area fraction of martensite having a C concentration in a range of more than 0.7×[% C] and less than 1.5×[% C] is 55% or more, an area fraction of tempered martensite having a C concentration of 0.7×[% C] or less is in a range of 5% or more and 40% or less, a ratio of a carbon concentration in retained austenite to a volume fraction of retained austenite is in a range of 0.05 or more and 0.40 or less, and the martensite and the tempered martensite each have an average grain size of 5.3 μm or less, the steel structure further having a surface layer softening thickness of 10 μm or more and 100 μm or less, where [% C] represents the content, by mass %, of compositional element C in the steel sheet".

CITATION LIST

Patent Literature

PTL 1: JP6747612B1

SUMMARY

Technical Problem

Among automotive frame structural components, crash boxes, for example, have punched end surface surfaces, etc. Therefore, it is preferable to apply steel sheets with high stretch flangeability to such components from the viewpoint of formability.

In addition, high strength steel sheets used for automotive frame structural components are required to have high component strength when formed into automotive frame structural components, etc. For increasing component strength, it is effective, for example, to increase the yield stress in the longitudinal direction of the component (hereinafter simply referred to as YS) or to increase the yield ratio of the steel sheet (=YS/TS×100, hereinafter simply referred to as YR). This increases the impact absorbed energy in the event of a vehicle collision (hereafter simply referred to as impact absorbed energy).

However, for high strength steel sheets having TS of 1180 MPa or more, there are restrictions on the width of the steel sheet from the viewpoint of manufacturability. In detail, it is difficult to manufacture a wide steel sheet with a high strength steel sheet having TS of 1180 MPa or more. Therefore, for automotive frame structural components, etc., the longitudinal direction of the component must be the rolling direction of the steel sheet (hereinafter simply referred to as the rolling direction) in some cases. In these cases, increasing YS in the rolling direction, and thus YR in the rolling direction, is very important to increase the impact absorbed energy.

However, in the high strength steel sheet described in PTL 1, no consideration is given to yield stress or yield ratio in the rolling direction. Therefore, from the viewpoint of increasing the application ratio of the high strength steel sheet to automotive frame structural components, there is a need to develop a high strength steel sheet with high stretch flangeability and high YR in the rolling direction as well as in the direction orthogonal to the rolling direction, having TS of 1180 MPa or more.

It could thus be helpful to provide a high strength steel sheet having high stretch flangeability and increased YR in the rolling direction as well as direction orthogonal to the rolling direction, in other words, providing high component strength when applied to components of various sizes and shapes, with TS of 1180 MPa or more.

It could also be helpful to provide a method for manufacturing the high strength steel sheet.

Furthermore, it could be helpful to provide a member made of the high strength steel sheet.

Here, the expression of "high stretch flangeability" means that the hole expansion ratio (hereinafter simply referred to as A) measured in accordance with JIS Z 2256 is 30% or more.

The expression of "high YR (i.e., high component strength)" means that the YRs in the rolling direction and the direction orthogonal to the rolling direction are 70% or more, and that the following formula is satisfied: YR in the rolling direction ≥YR in the direction orthogonal to the rolling direction (suitably, YR in the rolling direction >YR in the direction orthogonal to the rolling direction).

YR is obtained by the following formula (1):

$$YR = YS/TS \times 100. \quad (1)$$

TS and YS in the rolling direction and direction orthogonal to the rolling direction are measured in accordance with JIS Z 2241.

Solution to Problem

We therefore made intensive studies to achieve the objects stated above. As a result, we found that by simultaneously satisfying (1) through (4) below, a high strength steel sheet with high stretch flangeability and high YR in the rolling direction as well as in the direction orthogonal to the rolling direction can be obtained, with TS of 1180 MPa or more.

(1) After the chemical composition is prepared as prescribed, the microstructure shall consist mainly of the first hard phase and second hard phase as defined below, where, the first hard phase is an area where the carbon concentration measured by an electron probe microanalyzer at a position of a sheet thickness×¼ is more than 0.7×[% C] and less than 1.5×[% C], and the second hard phase is an area where the carbon concentration measured by the electron probe microanalyzer at a position of the sheet thickness×¼ is 0.05 or more and 0.7×[% C] or less.

(2) The average grain size of crystal grains constituting the first hard phase and second hard phase is 5.3 μm or less.

(3) The ratio of carbon concentration in retained austenite to the volume fraction of retained austenite is 0.10 or more and 0.45 or less.

(4) The integration degree of the {112}<111> orientation shall be 1.0 or more.

The present disclosure is based on these findings and further studies.

We thus provide the following.

1. A high strength steel sheet comprising a chemical composition containing (consisting of), in mass %,
   C: 0.090% or more and 0.390% or less,
   Si: 0.01% or more and 2.50% or less,
   Mn: 2.00% or more and 4.00% or less,
   P: 0.100% or less,
   S: 0.0200% or less,
   Al: 0.100% or less and
   N: 0.0100% or less, with the balance being Fe and inevitable impurities,
   wherein the high strength steel sheet has a steel microstructure in which an area ratio of a first hard phase is 55% or more,
   an area ratio of a second hard phase is 5% or more and 40% or less,
   an area ratio of a ferrite phase is less than 10%,
   the first hard phase and second hard phase has crystal grains with an average grain size of 5.3 μm or less,
   a ratio of carbon concentration in retained austenite to the volume fraction of the retained austenite is 0.10 or more and 0.45 or less, and
   an integration degree of the {112}<111> orientation is 1.0 or more, and
   the high strength steel sheet has a tensile strength of 1180 MPa or more
   where
   the first hard phase is an area having a carbon concentration of more than 0.7×[% C] and less than 1.5×[% C], which is measured by an electron probe microanalyzer at a position of a sheet thickness×¼,
   the second hard phase is an area having a carbon concentration of 0.05 or more and 0.7×[% C] or less, which is measured by the electron probe microanalyzer at the position of the sheet thickness×¼,
   the ferrite phase is an area having a carbon concentration of less than 0.05, which is measured by the electron probe microanalyzer at the position of the sheet thickness×¼, and
   the [% C] is a content in mass % of C in the chemical composition.
2. The high strength steel sheet according to 1, wherein the chemical composition further contains, in mass %, at least one selected from the group consisting of
   O: 0.0100% or less,
   Ti: 0.200% or less,
   Nb: 0.200% or less,
   V: 0.200% or less,
   Ta: 0.10% or less,
   W: 0.10% or less,
   B: 0.0100% or less,
   Cr: 1.00% or less,
   Mo: 1.00% or less,
   Ni: 1.00% or less,
   Co: 0.010% or less,
   Cu: 1.00% or less,
   Sn: 0.200% or less,
   Sb: 0.200% or less,
   Ca: 0.0100% or less,
   Mg: 0.0100% or less,
   REM: 0.0100% or less,
   Zr: 0.100% or less,
   Te: 0.100% or less,
   Hf: 0.10% or less and
   Bi: 0.200% or less.
3. The high strength steel sheet according to 1. or 2., comprising a coated or plated layer at a surface thereof.
4. A method for manufacturing a high strength steel sheet, comprising
   hot rolling a steel slab having the chemical composition according to 1. or 2. to obtain a hot-rolled steel sheet,
   then, subjecting the hot-rolled steel sheet to pickling,
   then, cold rolling the hot-rolled steel sheet with the number of passes of two or more and an accumulated rolling reduction ratio of 20% or more and 75% or less to obtain a cold-rolled steel sheet,
   then, subjecting the cold-rolled steel sheet to annealing with an average heating rate of 10° C./s or more within a temperature range of 250° C. to 700° C.
   and an annealing temperature of 820° C. or higher and 950° C. or lower, then, cooling the cold-rolled steel sheet with a staying time of 70 s or more and 700 s or less within a temperature range of 50° C. to 400° C.,
   then, working the cold-rolled steel sheet to give an equivalent plastic strain of 0.10% or more at a position of a sheet thickness×1/20 of the cold-rolled steel sheet.
5. The method for manufacturing a high strength steel sheet according to 4., comprising subjecting the cold-rolled steel sheet to coating or plating treatment.
6. A member made of the high strength steel sheet according to any one of 1. to 3.
7. The member according to 6. for automotive frame structural components or for automotive reinforcing components.

Advantageous Effect

According to this disclosure, a high strength steel sheet having high stretch flangeability and high YR in the rolling direction as well as in the direction orthogonal to the rolling direction with TS of 1180 MPa or more can be obtained.

In particular, the high strength steel sheet has high YR in the rolling direction as well as YR in the direction orthogonal to the rolling direction, making it possible to apply it to various sizes and shapes of automotive frame structural components while obtaining high component strength. This will improve fuel efficiency by reducing automotive body weight, which has tremendous industrial application value.

DETAILED DESCRIPTION

The presently disclosed techniques will be described below by way of embodiments.

[1] High Strength Steel Sheet

First, the chemical composition of the high strength steel sheet according to one of the disclosed embodiments is described. The % representations below indicating the chemical composition are in mass % unless stated otherwise.

C: 0.090% or More and 0.390% or Less

C is one of the important basic components. In detail, C is an element that particularly affects the fractions of the first hard phase, second hard phase, and retained austenite, as well as the carbon concentration in the retained austenite. Here, if the C content is less than 0.090%, the fraction of the first hard phase decreases and it becomes difficult to achieve TS of 1180 MPa or more. On the other hand, if the C content exceeds 0.390%, the fraction of the second hard phase decreases and it becomes difficult to achieve λ of 30% or more. Therefore, the C content is set to 0.090% or more and 0.390% or less. The C content is preferably 0.100% or more, more preferably 0.110% or more. The C content is preferably 0.360% or less, more preferably 0.350% or less.

Si: 0.01% or More and 2.50% or Less

Si suppresses carbide formation during continuous annealing and promotes the formation of retained austenite. In detail, Si is an element that affects the fraction of the retained austenite and the carbon concentration in the retained austenite. Here, if the Si content is less than 0.01%, the carbon concentration in the retained austenite is not sufficient to achieve the desired YR. On the other hand, if the Si content exceeds 2.50%, the carbon concentration in the retained austenite increases excessively. Therefore, the hardness of martensite, which transforms from the retained austenite when the steel sheet is blanked, increases significantly. This increases the amount of voids generated during blanking and during hole expanding, resulting in lower λ. Therefore, the Si content is set to 0.01% or more and 2.50% or less. The Si content is preferably 0.10% or more, more preferably 0.15% or more. The Si content is preferably 2.00% or less, more preferably 1.50% or less.

Mn: 2.00% or More and 4.00% or Less

Mn is one of the important basic components. In detail, Mn is an important element that particularly affects the fractions of the first hard phase and second hard phase. Here, if the Mn content is less than 2.00%, the fraction of the first hard phase decreases and it becomes difficult to achieve TS of 1180 MPa or more. On the other hand, if the Mn content exceeds 4.00%, the fraction of the second hard phase decreases and it becomes difficult to achieve λ of 30% or more. Therefore, the Mn content is set to 2.00% or more and 4.00% or less. The Mn content is preferably 2.20% or more, more preferably 2.50% or more. The Mn content is preferably 3.80% or less, more preferably 3.60% or less.

P: 0.100% or Less

P segregates in prior austenite grain boundaries and embrittles the grain boundaries. As a result, the ultimate deformability of the steel sheet decreases, and thus λ decreases. Therefore, the P content is set to 0.100% or less. The P content is preferably 0.070% or less. Although no lower limit is placed on the P content, since P is a solid-solution-strengthening element and can increase the strength of the steel sheet, the P content is preferably 0.001% or more.

S: 0.0200% or Less

S is present as sulfides and reduces the ultimate deformability of the steel. Accordingly, λ decreases. Therefore, the S content is set to 0.0200% or less. The S content is preferably 0.0050% or less. Although no lower limit is placed on the S content, due to manufacturing technology restrictions, the S content is preferably 0.0001% or more.

Al: 0.100% or Less

Al is an element that raises the A3 transformation temperature and forms a ferrite phase in the steel microstructure. Here, if a large amount of ferrite phase is formed in the steel microstructure, it becomes difficult to achieve the desired YR. Therefore, the Al content is set to 0.100% or less. The Al content is preferably 0.050% or less. No lower limit is placed on the Al content. However, Al suppresses carbide formation during continuous annealing and promotes the formation of retained austenite. In detail, Al affects the fraction of retained austenite and the carbon concentration in the retained austenite. Therefore, the Al content is preferably 0.001% or more.

N: 0.0100% or Less

N exists as nitrides and reduces the ultimate deformability of the steel. Accordingly, λ decreases. Therefore, the N content is set to 0.0100% or less. The N content is preferably 0.0050% or less. Although no lower limit is placed on the N content, due to manufacturing technology restrictions, the N content is preferably 0.0005% or more.

The high strength steel sheet according to one of the disclosed embodiments has a chemical composition containing the above elements with the balance being Fe and inevitable impurities. The high strength steel sheet according to one of the disclosed embodiments preferably has a chemical composition consisting of the above elements with the balance being Fe and inevitable impurities. The inevitable impurities include Zn, Pb, and As. These impurities are permitted to be contained as long as they are 0.100% or less in total.

The basic chemical composition of the high strength steel sheet according to one of the disclosed embodiments has been described above. In addition, at least one of the optional additive elements below can be contained alone or in combination:

O: 0.0100% or less,
Ti: 0.200% or less,
Nb: 0.200% or less,
V: 0.200% or less,
Ta: 0.10% or less,
W: 0.10% or less,
B: 0.0100% or less,
Cr: 1.00% or less,
Mo: 1.00% or less,
Ni: 1.00% or less,
Co: 0.010% or less,
Cu: 1.00% or less,
Sn: 0.200% or less,
Sb: 0.200% or less,
Ca: 0.0100% or less,
Mg: 0.0100% or less,
REM: 0.0100% or less,
Zr: 0.100% or less,
Te: 0.100% or less,
Hf: 0.10% or less and
Bi: 0.200% or less.

The following describes the optimum content of each element when the optional additive element is contained.

O: 0.0100% or Less

O exists as oxides and reduces the ultimate deformability of the steel. Accordingly, λ decreases. Therefore, the O content is set to 0.0100% or less. The O content is preferably 0.0050% or less. Although no lower limit is placed on the O content, due to manufacturing technology restrictions, the O content is preferably 0.0001% or more.

Ti: 0.200% or Less, Nb: 0.200% or Less, V: 0.200% or Less

Ti, Nb, and V form precipitates and inclusions. When such precipitates and inclusions coarsen to be formed in large amounts, they reduce the ultimate deformability of the steel sheet. Accordingly, λ decreases. Therefore, each of the contents of Ti, Nb, and V is set to 0.200% or less. Each of the contents of Ti, Nb, and Vis preferably 0.100% or less. No lower limit is placed on the Ti, Nb and V contents. The addition of Ti, Nb, and V, however, increases the recrystallization temperature during the heating process of continuous annealing. This refines the crystal grains that constitute the first hard phase and second hard phase, contributing to an increase in YR. Therefore, each of the contents of Ti, Nb, and V is preferably 0.001% or more.

Ta: 0.10% or Less, W: 0.10% or Less

Ta and W form precipitates and inclusions. When such precipitates and inclusions coarsen to be formed in large amounts, they reduce the ultimate deformability of the steel sheet. Accordingly, λ decreases. Therefore, each of the contents of Ta and W is set to 0.10% or less. Each of the contents of Ta and W is preferably 0.08% or less. No lower limit is placed on the Ta and W contents. However, Ta and W increase the strength of the steel sheet by forming fine carbides, nitrides or carbonitrides during hot rolling or continuous annealing. Therefore, each of the contents of Ta and W is preferably 0.01% or more.

B: 0.0100% or Less

B contributes to the formation of cracks inside the steel sheet during casting or hot rolling and reduces the ultimate deformability of the steel sheet. Accordingly, λ decreases. Therefore, the B content is set to 0.0100% or less. The B content is preferably 0.0080% or less. No lower limit is placed on the B content. However, B is an element that segregates at austenite grain boundaries during annealing and improves hardenability. Therefore, the B content is preferably 0.0003% or more.

Cr: 1.00% or Less, Mo: 1.00% or Less, Ni: 1.00% or Less

Excessive Cr, Mo, and Ni contents increase coarse precipitates and inclusions and reduces the ultimate deformability of the steel sheet. Accordingly, λ decreases. Therefore, each of the contents of Cr, Mo, and Ni is set to 1.00% or less. Each of the contents of Cr, Mo, and Ni is preferably 0.80% or less. No lower limit is placed on the Cr, Mo, and Ni contents. However, Cr, Mo and Ni are all elements that improve hardenability. Therefore, each of the contents of Cr, Mo, and Ni is preferably 0.01% or more.

Co: 0.010% or Less

An excessive Co content increases coarse precipitates and inclusions and reduces the ultimate deformability of the steel sheet. Accordingly, λ decreases. Therefore, the Co content is set to 0.010% or less. The Co content is preferably 0.008% or less. No lower limit is placed on the Co content. However, Co is an element that improves hardenability. Therefore, the Co content is preferably 0.001% or more.

Cu: 1.00% or Less

An excessive Cu content increases coarse precipitates and inclusions and reduces the ultimate deformability of the steel sheet. Accordingly, λ decreases. Therefore, the Cu content is set to 1.00% or less. The Cu content is preferably 0.80% or less. No lower limit is placed on the Cu content. However, Cu is an element that improves hardenability. Therefore, the Cu content is preferably 0.01% or more.

Sn: 0.200% or Less

Sn contributes to the formation of cracks inside the steel sheet during casting or hot rolling and reduces the ultimate deformability of the steel sheet. Accordingly, λ decreases. Therefore, the Sn content is set to 0.200% or less. The Sn content is preferably 0.100% or less. No lower limit is placed on the Sn content. However, Sn is an element that improves hardenability. Therefore, the Sn content is preferably 0.001% or more.

Sb: 0.200% or Less

An excessive Sb content increases coarse precipitates and inclusions and reduces the ultimate deformability of the steel sheet. Accordingly, λ decreases. Therefore, the Sb content is set to 0.200% or less. The Sb content is preferably 0.100% or less. No lower limit is placed on the Sb content. However, Sb is an element that controls surface layer softening thickness and allows strength adjustment. Therefore, the Sb content is preferably 0.001% or more.

Ca: 0.0100% or Less, Mg: 0.0100% or Less, REM: 0.0100% or Less

Excessive Ca, Mg, and REM contents increase coarse precipitates and inclusions and reduces the ultimate deformability of the steel sheet. Accordingly, λ decreases. Therefore, each of the contents of Ca, Mg, and REM is set to 0.0100% or less. Each of the contents of Ca, Mg, and REM is preferably 0.0050% or less. No lower limit is placed on the Ca, Mg, and REM contents. However, Ca, Mg, and REM are all elements that form nitrides and sulfides into a spherical shape and improve the ultimate deformability of the steel sheet. Therefore, each of the contents of Ca, Mg, and REM is preferably 0.0005% or more.

Zr: 0.100% or Less, Te: 0.100% or Less

Excessive Zr and Te contents increase coarse precipitates and inclusions and reduces the ultimate deformability of the steel sheet. Accordingly, λ decreases. Therefore, each of the contents of Zr and Te is set to 0.100% or less. Each of the contents of Zr and Te is preferably 0.080% or less. No lower limit is placed on the Zr and Te contents. However, Zr and Te are elements that form nitrides and sulfides into a spherical shape and improve the ultimate deformability of the steel sheet. Therefore, each of the contents of Zr and Te is preferably 0.001% or more.

Hf: 0.10% or Less

An excessive Hf content increases coarse precipitates and inclusions and reduces the ultimate deformability of the steel sheet. Accordingly, A decreases. Therefore, the Hf content is set to 0.10% or less. The Hf content is preferably 0.08% or less. No lower limit is placed on the Hf content. However, Hf is an element that form nitrides and sulfides into a spherical shape and improves the ultimate deformability of the steel sheet. Therefore, the Hf content is preferably 0.01% or more.

Bi: 0.200% or Less

An excessive Bi content increases coarse precipitates and inclusions and reduces the ultimate deformability of the steel sheet. Accordingly, A decreases. Therefore, the Bi content is set to 0.200% or less. The Bi content is preferably 0.100% or less. No lower limit is placed on the Bi content. However, Bi is an element that reduces segregation. Therefore, the Bi content is preferably 0.001% or more.

O, Ti, Nb, V, Ta, W, B, Cr, Mo, Ni, Co, Cu, Sn, Sb, Ca, Mg, REM, Zr, Te, Hf, and Bi described above shall be contained as inevitable impurities, since the effect of the technique of this disclosure will not be harmed if the content of each element is below the preferred lower limit.

Next, the steel structure of the high strength steel sheet according to one of the disclosed embodiments is described.

In the steel structure of the high strength steel sheet according to one of the disclosed embodiments, the area ratio of the first hard phase is 55% or more, the area ratio of the second hard phase is 5% or more and 40% or less, the area ratio of the ferrite phase is less than 10%, the first hard phase and second hard phase has crystal grains with an average grain size of 5.3 μm or less, the ratio of carbon concentration in retained austenite to the volume fraction of the retained austenite is 0.10 or more and 0.45 or less, and the integration degree of the {112}<111> orientation is 1.0 or more, where the first hard phase is an area having a carbon concentration of more than 0.7×[% C] and less than 1.5×[% C], which is measured by an electron probe microanalyzer at a position of a sheet thickness×¼, the second hard phase is an area having a carbon concentration of 0.05 or more and 0.7×[% C] or less, which is measured by the electron probe microanalyzer at the position of the sheet thickness×¼, the ferrite phase is an area having a carbon concentration of less than 0.05, which is measured by the electron probe microanalyzer at the position of the sheet thickness×¼, and the [% C] is a content in mass % of C in the chemical composition.

The observation position of the steel microstructure is at the position of the sheet thickness×¼, unless otherwise specified.

Area Ratio in First Hard Phase: 55% or More

By using the first hard phase as the main phase, specifically, by setting the area ratio of the first hard phase to 55% or more, it is possible to achieve TS of 1180 MPa or more. Therefore, the area ratio of the first hard phase is set to 55% or more. The area ratio of the first hard phase is preferably 56% or more, more preferably 57% or more. No upper limit is placed on the area ratio of the first hard phase, but from the viewpoint of achieving the desired λ and YR, the area ratio of the first hard phase is preferably 95% or less and more preferably 90% or less.

The first hard phase is an area having a carbon concentration of more than 0.7×[% C] and less than 1.5×[% C], which is measured by the electron probe microanalyzer at the position of the sheet thickness×¼. The first hard phase consists mainly of quenched martensite (fresh martensite).

Area Ratio of Second Hard Phase: 5% or More and 40% or Less

The presence of the second hard phase in addition to the first hard phase described above makes it possible to achieve the desired λ and YR. To achieve these effects, the area ratio of the second hard phase needs to be 5% or more. On the other hand, when the area ration of the second hard phase exceeds 40%, the area ratio of the first hard phase decreases and it becomes difficult to achieve TS of 1180 MPa or more. Therefore, the area ratio of the second hard phase is set to 5% or more and 40% or less. The area ratio of the second hard phase is preferably 6% or more, more preferably 7% or more. The area ratio of the second hard phase is preferably 39% or less, more preferably 38% or less.

The second hard phase is an area having a carbon concentration of 0.05 or more and 0.7×[% C] or less, which is measured by the electron probe microanalyzer at the position of the sheet thickness×¼. The second hard phase consists mainly of tempered martensite and bainite.

Area Ratio of Ferrite Phase: Less Than 10%

YR is increased by reducing the area ratio of the ferrite phase to less than 10%. Also, λ is increased. On the other hand, when the area ratio of the ferrite phase exceeds 10%, YR is decreased. The difference in hardness between the first hard phase as main phase and the ferrite phase also reduces λ. Therefore, the area ratio of the ferrite phase is set to less than 10%. The area ratio of the ferrite phase is preferably 8% or less, more preferably 6% or less. The area ratio of the ferrite phase may be 0%. However, from the viewpoint of improving ductility, the area ratio of the ferrite phase is preferably 1% or more, more preferably 2% or more.

The ferrite phase is an area having a carbon concentration of less than 0.05, which is measured by the electron probe microanalyzer at the position of the sheet thickness×¼. The ferrite phase here may also be defined as bainitic ferrite.

Here, the area ratios of the first hard phase, second hard phase and ferrite phase are measured as follows.

In detail, a sample is cut from a steel sheet so that a cross section (L-cross section) along the sheet thickness direction parallel to the rolling direction becomes the observation plane. Then, the observation plane of the sample is subjected to polishing with diamond paste, followed by finish polishing with alumina. Then, on the observation plane of the sample, the observation position is set at a position of the sheet thickness×¼ of the steel sheet (i.e., the position of the sheet thickness×¼ of the steel sheet is at the center position in the thickness direction of the measurement area), and the carbon concentration is measured in three fields using an electron probe micro analyzer (EPMA) under the following conditions: accelerating voltage: 7 kV, measurement area: 22.5 μm×22.5 μm. The conversion of the measured data to carbon concentration is performed by the calibration curve method. Then, in the three fields obtained, the frequencies corresponding to the first hard phase, second hard phase, and ferrite phase from the carbon concentrations are calculated, dividing each by the total frequency of the measurement areas, and multiplying by 100 to thereby determine the area ratios of the first hard phase, second hard phase, and ferrite phase.

The area ratio of the residual microstructure other than the first hard phase, second hard phase, and ferrite phase is preferably 10% or less. The area ratio of the residual microstructure is calculated by the following formula:

$$[\text{Area ratio of residual microstructure}(\%)] = 100 - [\text{area ratio of first hard phase}(\%)] - [\text{area ratio of second hard phase}(\%)] - [\text{area ratio of ferrite phase}(\%)].$$

The residual microstructure includes retained austenite and other publicly known microstructures of steel sheets, such as pearlite, cementite, and carbides such as metastable carbide (epsilon (ε) carbide, eta (η) carbide, chi (χ) carbide, etc.).

Of the residual microstructure, the volume fraction of the retained austenite is preferably 5% or less. The volume fraction of the retained austenite is preferably more than 0%. The volume fraction of the retained austenite can be read as area ratio of retained austenite, assuming that the retained austenite is three dimensionally homogeneous. In addition, the area ratio of the microstructure other than retained austenite is preferably 5% or less. Identification of the residual microstructure and measurement of area ratio for microstructure other than the retained austenite can be done, for example, by observation with a scanning electron microscope (SEM). The volume fraction of the retained austenite may be determined by the method described below.

Average grain size of crystal grains constituting first hard phase and second hard phase (hereinafter also referred to as average grain size of hard phase): 5.3 μm or less YR can be increased by refining the crystal grains that constitute the first hard phase and second hard phase. Therefore, the average grain size of the hard phase is set to 5.3 μm or less. The average grain size of the hard phase is preferably 5.0 μm or less, more preferably 4.9 μm or less. No lower limit is placed on the average grain size of the hard phase, but from the viewpoint of achieving the desired λ, the average grain size of the hard phase is preferably 1.0 μm or more, more preferably 2.0 μm or more.

Here, the average grain size of the crystal grains constituting the first hard phase and second hard phase is measured as follows.

In detail, using wet polishing and buffing with a colloidal silica solution, smoothed is the surface of the cross section (L-cross section) along the sheet thickness direction parallel to the rolling direction of the steel sheet. Then, the surface is etched with 0.1 vol. % nital so as to reduce irregularities thereon as much as possible and completely remove the work affected layer. Then, with the electron back-scatter diffraction (SEM-EBSD) method using the position at the sheet thickness×¼ of the steel sheet as observation position, the crystal orientation is measured with the phase set to Iron-Alpha and Iron-Gamma and a step size of 0.05 μm. From the obtained crystal orientation data, first, the retained austenite information is removed by using OIM Analysis available from AMETEK EDAX with the phase set to only Iron-Alpha. Then, the obtained crystal orientation data is cleaned up once using the grain dilation method (Grain Tolerance Angle: 5, Minimum Grain Size: 2), and Confidence Index (CI)>0.05 is set as the threshold value. Then, the ferrite phase is removed. The grain boundary is then defined as a case where the inter-pixel orientation difference is 5° or more to thereby calculate the average grain size of the crystal grains constituting the first hard phase and second hard phase.

Ratio of carbon concentration in retained austenite to volume fraction of retained austenite (hereinafter also referred to as volume fraction-carbon concentration ratio of retained austenite (γ)): 0.10 or more and 0.45 or less The volume fraction-carbon concentration ratio of retained austenite (γ) ([carbon concentration in retained austenite (mass %)]/[volume fraction of retained austenite (vol. %)]) is an extremely important requirement. In detail, the desired YR can be achieved by controlling the volume fraction of the retained austenite and the carbon concentration in the retained austenite in a combined manner. Therefore, the volume fraction-carbon concentration ratio of retained austenite (γ) is set to 0.10 or more. On the other hand, when the volume fraction-carbon concentration ratio of retained austenite (γ) exceeds 0.45, the hardness of martensite, which transforms from the retained austenite when the steel sheet is blanked, increases significantly. Therefore, the amount of voids generated is increased during blanking and hole expanding, resulting in lower λ. Accordingly, the volume fraction-carbon concentration ratio of retained austenite (γ) is set to 0.10 or more and 0.45 or less. The volume fraction-carbon concentration ratio of retained austenite (γ) is preferably 0.12 or more, more preferably 0.14 or more. The volume fraction-carbon concentration ratio of retained austenite (γ) is preferably 0.43 or less, more preferably 0.41 or less.

Here, the volume fraction of the retained austenite is measured as follows.

In detail, the steel sheet is ground so that the observation plane is at the position of the sheet thickness×¼ from the surface of the steel sheet (the position corresponding to the sheet thickness×¼ in the depth direction from the surface of the steel sheet), and then further polished by chemical polishing as 0.1 mm. Then, on the observation plane, the integrated reflection intensities of the (200), (220), and (311) planes of fcc iron (austenite) and the (200), (211), and (220) planes of bcc iron are measured using an X-ray diffraction system with a Co Kα source. The volume fraction of retained austenite is determined from the intensity ratio of the integrated reflection intensity from each plane of fcc iron (austenite) to the integrated reflection intensity from each plane of bcc iron.

The carbon concentration in the retained austenite is measured as follows.

First, the lattice constant a of the retained austenite is calculated from the position of the diffraction peak (2θ) on the (220) plane of austenite using the formula (2) below. The position of the diffraction peak on the (220) plane of austenite is obtained from the X-ray diffraction measurement when the volume fraction of the retained austenite is measured. The carbon concentration in the retained austenite is then calculated by substituting the lattice constant a of the retained austenite into the formula (3) below.

$$a = 1.79021\sqrt{2}/\sin\theta \tag{2}$$

$$a = 3.578 + 0.00095\,[\%\ \mathrm{Mn}] + 0.022\,(\%\ \mathrm{N}] + 0.0006\,[\%\ \mathrm{Cr}] + 0.0031\,[\%\ \mathrm{Mo}] + 0.0051\,[\%\ \mathrm{Nb}] + 0.0039\,[\%\ \mathrm{Ti}] + 0.0056\,[\%\ \mathrm{Al}] + 0.033\,[\%\ \mathrm{C}] \tag{3}$$

where a: Lattice constant (Å) of retained austenite,

θ: value (rad) obtained by dividing position of diffraction peak (2θ) on (220) plane of austenite by 2,

[% M]: Content in mass % of element M (excluding C) throughout steel,

[% C]: Carbon concentration in mass % in retained austenite.

Integration Degree of {112}<111> Orientation: 1.0 or More

The integration degree of {112}<111> orientation is an extremely important requirement. By increasing the integration degree of {112}<111> orientation, the yield ratio in the rolling direction can be preferentially increased. To achieve this effect, the integration degree of {112}<111> orientation is set to 1.0 or more. The integration degree of {112}<111> orientation is preferably 1.1 or more, more preferably 1.2 or more. No upper limit is placed on the integration degree of {112}<111> orientation, but when the integration degree of {112}<111> orientation is excessively high, YR in the direction orthogonal to the rolling direction may decrease. Therefore, the integration degree of {112}<111> orientation is preferably 9.0 or less, more preferably less 6.0 or less.

Here, the integration degree of {112}<111> orientation is measured as follows.

In detail, using wet polishing and buffing with a colloidal silica solution, smoothed is the surface of a cross section (L-cross section) along the sheet thickness direction parallel to the rolling direction of the steel sheet. Then, the surface is etched with 0.1 vol. % nital so as to reduce irregularities thereon as much as possible and completely remove the work affected layer. Then, with the electron back-scatter diffraction (SEM-EBSD) method using the position at the sheet thickness×¼ of the steel sheet as observation position, the crystal orientation is measured. Then, from the obtained data, the integration degree of {112}<111> orientation is determined using OIM Analysis available from AMETEK EDAX For the high strength steel sheet according to one of the disclosed embodiments, the surface layer softening thickness is preferably 10 μm or more. The surface layer softening thickness is preferably 100 μm or less.

In detail, λ can be further improved by softening the surface layer of the steel sheet compared to the position of the sheet thickness×¼ of the steel sheet. Therefore, the surface layer softening thickness is preferably 10 μm or more. On the other hand, when the surface layer softening thickness exceeds 100 μm, TS may decrease. Therefore, the surface layer softening thickness is preferably 10 μm or more. The surface layer softening thickness is preferably 100 μm or less. The surface layer softening thickness is more preferably 12 μm or more, further preferably 15 μm or more. The surface layer softening thickness is more preferably 80 μm or less, further preferably 60 μm or less.

The surface layer softening thickness is measured as follows.

In detail, using wet polishing, smoothed is the surface of a cross section (L-cross section) along the sheet thickness direction parallel to the rolling direction of the steel sheet. Then, using a Vickers hardness meter, the hardness is measured at 5 μm intervals in the sheet thickness (depth) direction from the 10 μm depth position from the surface to a mid-thickness position under a load of 5 gf. The hardness obtained at the position of the sheet thickness×¼ of the steel sheet is used as reference hardness, and the distance (depth) from the surface of the steel sheet to a position of deepest depth where the hardness is equal to or less than the reference hardness×0.85 is measured, and the measured value is used as surface layer softening thickness.

Since the steel microstructure of the steel sheet is usually approximately vertically symmetrical in the thickness direction, for identification of the microstructure and measurement of the average grain size of the hard phase, volume fraction-carbon concentration ratio of retained austenite (γ), integration degree of {112}<111> orientation, and surface layer softening thickness, any one of the steel sheet surfaces (front and rear surfaces) can be representative, for example, any one of the steel sheet surfaces (front and rear surfaces) can be the initiation point (position of sheet thickness×0) of the position in the sheet thickness, such as the position of sheet thickness×¼. The same applies below.

Tensile Strength (TS): 1180 MPa or More

TS of the high strength steel sheet according to one of the disclosed embodiments is 1180 MPa or more. The expression of "TS: 1180 MPa or more" here means that TS measured in the rolling direction and direction orthogonal to the rolling direction is 1180 MPa or more. TS is measured in accordance with JIS Z 2241, as described in the EXAMPLES section below.

The sheet thickness of the high strength steel sheet according to one of the disclosed embodiments is not particularly limited, but is usually 0.3 mm or more and 2.8 mm or less.

In addition, the high strength steel sheet according to one of the disclosed embodiments may have coated or plated layer on the surface. The type of coated or plated layer is not limited and can be, for example, hot-dip coating layer or electroplating layer. The coated or plated layer may also be an alloyed coated or plated layer. The coated or plated layer is preferably a galvanized layer. The galvanized layer may contain Al or Mg. Hot-dip zinc-aluminum-magnesium alloy coating (Zn—Al—Mg coated layer) is also preferred. In this case, the Al content is preferably 1 mass % or more. The Al content is preferably 22 mass % or less. The Mg content is preferably 0.1 mass % or more. The Mg content is preferably 10 mass % or less. The balance is preferably Zn. Further, the Zn—Al—Mg coated layer may contain 1 mass % or less in total of at least one selected from Si, Ni, Ce, and La. The coating or plating metal is not limited, and Al coating or plating, etc., is acceptable in addition to Zn coating or plating as described above. The coated or plated layer may be provided on one or both sides of the steel sheet.

The composition the coated or plated layer is not particularly limited and may be general one. For example, in the case of hot-dip galvanized layer or galvannealed layer, generally, the composition contains Fe of 20 mass % or less, Al of 0.001 mass % or more and 1.0 mass % or less, and at least one selected from the group consisting of Pb, Sb, Si, Sn, Mg, Mn, Ni, Cr, Co, Ca, Cu, Li, Ti, Be, Bi, REM of 0 mass % or more and 3.5 mass % or less in total, with the balance being Zn and inevitable impurities. In the case of the hot-dip galvanized layer, the Fe content in the coated layer is preferably less than 7 mass %. In the case of galvannealed layer, the Fe content in the coated layer is preferably 7 mass % or more. The Fe content in the coated layer is preferably 20 mass % or less.

Furthermore, the coating or plating weight per side of the coated or plated layer is not limited, but for example, for a hot-dip galvanized layer or galvannealed layer (in which hot-dip galvanizing is alloyed), 20 g/m$^2$ or more is preferred. 80 g/m$^2$ or less is preferred.

[2] Method for Manufacturing High Strength Steel Sheet

Next, the method for manufacturing the high strength steel sheet according to one of the disclosed embodiments is described.

The method for manufacturing the high strength steel sheet according to one of the disclosed embodiments comprises hot rolling a steel slab having the above chemical composition to obtain a hot-rolled steel sheet, then, subjecting the hot-rolled steel sheet to pickling, then, cold rolling the hot-rolled steel sheet with the number of passes of two or more and an accumulated rolling reduction ratio of 20% or more and 75% or less to obtain a cold-rolled steel sheet, subjecting the cold-rolled steel sheet to annealing with an average heating rate of 10° C./s or more within a temperature range of 250° C. to 700° C. and an annealing temperature of 820° C. or higher and 950° C. or lower, then, cooling the cold-rolled steel sheet with a staying time of from 70 s or more and 700 s or less within a temperature range of 50° C. to 400° C., then, working the cold-rolled steel sheet to give an equivalent plastic strain of 0.10% or more at a position of a sheet thickness×1/20 of the cold-rolled steel sheet.

The method for manufacturing a high strength steel sheet according to one of the disclosed embodiments is a method for manufacturing the high strength steel sheet according to one of the disclosed embodiments described above.

Unless otherwise specified, all of the above temperatures are based on the surface temperature of the steel slab or steel sheet.

[Hot Rolling Process]

First, the steel slab is hot rolled to obtain a hot-rolled steel sheet. The hot rolling conditions are not limited and may be in accordance with conventional methods.

For example, the method for preparing the steel slab (steel material) is not particularly limited and any publicly known preparing method such as a converter, electric furnace, and the like can be suitably employed. The steel slab is preferably manufactured by the continuous casting method to prevent macro-segregation. The steel slab can also be manufactured by ingot casting or thin slab casting. In addition to the conventional method of manufacturing a steel slab, then cooling the steel slab to room temperature, and heating them again, energy-saving processes such as hot direct rolling and direct rolling can also be applied without problems. The hot direct rolling is a process in which the slab is charged into a heating furnace as a warm slab without cooling to room temperature. The direct rolling is a process in which rolling is performed immediately after slight heat retention.

When the steel slab is heated, the slab heating temperature is preferably 1100° C. or higher from the viewpoint of carbide dissolution and reduction of rolling load. The slab heating temperature is preferably 1300° C. or lower to prevent increased scale loss. The slab heating temperature is the temperature of the slab surface.

The steel slab is then subjected to rough rolling under normal conditions to obtain a sheet bar. When the heating temperature is relatively low, the sheet bar is preferably heated using a bar heater or the like prior to finish rolling from the viewpoint of preventing troubles during rolling. The rolling finish temperature is preferably equal to or higher than $Ar_3$ transformation temperature. Excessively lowering the rolling finish temperature leads to increased rolling loads and higher rolling reduction in a state in which recrystallization of austenite does not occur. This may lead to the development of an abnormal microstructure elongated in the rolling direction, resulting in reduced workability of the steel sheet obtained after annealing. The $Ar_3$ transformation temperature is determined by the following formula.

$$Ar_3(°\ C.) = 868 - 396 \times [\%\ C] + 24.6 \times [\%\ Si] - 68.1 \times [\%\ Mn] - 36.1 \times [\%\ Ni] - 20.7 \times [\%\ Cu] - 24.8 \times [\%\ Cr]$$

The [% element symbol] in the above formula represents the content in mass % of the relevant element in the above chemical composition.

Because there is a concern that sheet passing properties is deteriorated during cold rolling and continuous annealing, coiling temperature after hot rolling is preferably 300° C. or higher. Coiling temperature after hot rolling is preferably 700° C. or lower.

Finish rolling may be performed continuously by welding sheet bars together. The sheet bar may be coiled on a temporary basis. At least part of finish rolling may be conducted as lubrication rolling to reduce rolling load during rolling. Conducting lubrication rolling is effective in terms of making the shape and material properties of the steel sheet uniform. In lubrication rolling, the frictional coefficient is preferably 0.10 or more. The coefficient of friction is preferably 0.25 or less.

[Pickling Process]

After the hot rolling process, the hot-rolled steel sheet is subjected to pickling. Pickling can remove oxides from the steel sheet surface, ensuring good chemical convertibility and coating or plating quality. The pickling may be performed only once or multiple times. Pickling conditions are not particularly limited, and conventional methods can be followed.

After pickling, the hot-rolled steel sheet may be subjected to optional heat treatment (hot-rolled sheet annealing). Heat treatment conditions are not particularly limited, and conventional method can be followed.

[Cold Rolling Process]

The hot-rolled steel sheet is then cold rolled into a cold-rolled steel sheet. In this case, it is important to satisfy the following conditions.

Number of Rolling Passes: Two or More

By cold rolling the hot-rolled steel sheet with the number of rolling passes of two or more, a large amount of shear zone is introduced into the steel sheet, and the austenite grains formed during the subsequent annealing process can be made finer. This refines the crystal grains that constitute the first hard phase and second hard phase, contributing to an increase in YR. In addition, the cold rolling process introduces a uniform shear zone into the steel sheet, which increases the integration degree of {112}<111> orientation. As a result, the yield ratio in the rolling direction can be preferentially increased. On the other hand, if the number of rolling passes is one, non-uniform shear zone is introduced in a small amount. As a result, the austenite grains formed during the subsequent annealing process become coarse, and the desired YR cannot be obtained. In addition, the integration degree of {112}<111> orientation cannot be increased sufficiently, and the yield ratio in the rolling direction cannot be preferentially increased. Therefore, the number of rolling passes for cold rolling is set to two or more. The number of rolling passes for cold rolling is preferably three or more, more preferably four or more, and further preferably five or more. No upper limit is placed on the number of rolling passes for cold rolling, but from the viewpoint of productivity, the number of rolling passes for cold rolling is preferably 10 passes or less.

Cold rolling with the number of rolling passes of two or more can be performed, for example, by tandem-type multiple stand rolling or reverse rolling.

Accumulated Rolling Reduction Ratio: 20% or More and 75% or Less

By setting the accumulated rolling reduction ratio of cold rolling to 20% or more, the area ratio of the ferrite phase can be less than 10%. This results in increased YR and, in turn, excellent component strength. On the other hand, when the accumulated rolling reduction ratio of cold rolling exceeds 75%, the austenite formed during annealing become excessively fine, and the amount of retained austenite in the steel sheet as final product increases. This makes it difficult to control the volume fraction-carbon concentration ratio of the retained austenite within an appropriate range, and the desired YR cannot be achieved. Therefore, the accumulated rolling reduction ratio of cold rolling is set to 20% or more and 75% or less. The accumulated rolling reduction ratio of cold rolling is preferably 25% or more, more preferably 27% or more. The accumulated rolling reduction ratio of cold rolling is preferably 70% or less, more preferably 60% or less.

[Annealing Process]

The cold-rolled steel sheet obtained as described above is annealed. In this case, it is important to satisfy the conditions below. The temperatures below are all based on the steel sheet surface temperature.

Average heating rate within temperature range of 250° C. to 700° C. (hereinafter referred to as heating temperature range): 10° C./s or higher By increasing the average heating rate within the heating temperature range, the crystal grains that constitute the first hard phase and second hard phase are refined, contributing to an increase in YR. Therefore, the average heating rate within the heating temperature range is set to 10° C./s or higher. The average heating rate within the heating temperature range is preferably 12° C./s or higher, more preferably 14° C./s or higher. No upper limit is placed on the average heating rate within the heating temperature range, but from the viewpoint of productivity, the average heating rate within the heating temperature is preferably 50° C./s or lower, more preferably 40° C./s or lower.

Annealing Temperature: 820° C. or Higher and 950° C. or Lower

An annealing temperature below 820° C. results in annealing treatment in the two-phase region of ferrite and austenite. In such cases, a large amount of ferrite is contained in the annealed steel sheet, making it difficult to achieve the desired YR and λ. On the other hand, if the annealing temperature exceeds 950° C., the austenite crystal grains coarsen during annealing and the average grain sizes of the first hard phase and second hard phase increase. Therefore, the desired YR cannot be achieved. Therefore, the annealing temperature is set to 820° C. or higher and 950° C. or lower. The annealing temperature is preferably 850° C. or higher, more preferably 870° C. or higher. The annealing temperature is preferably 940° C. or lower, more preferably 930° C. or lower. The annealing temperature is maximum arrival temperature in the annealing process.

The heat holding time in the annealing temperature range (820° C. to 950° C.) (hereinafter also referred to as annealing time) is not particularly limited, but is preferably 10 s or more. The annealing time is preferably 600 s or less. The temperature during heat holding does not always have to be constant.

The oxygen concentration during heat holding (oxygen concentration in the annealing temperature range) is not particularly limited but is preferably 2 volume ppm or more. The oxygen concentration during heat holding is preferably 30 volume ppm or less. The dew point during heat holding (dew point in the annealing temperature range) is not particularly limited, but is preferably −35° C. or higher. The dew point during heat holding is preferably 15° C. or lower.

[Cooling Process]

After the above annealing process, the cold-rolled steel sheet is cooled. In this case, it is important to satisfy the conditions below.

Staying time within the temperature range of 50° C. to 400° C. (hereinafter referred to as cooling temperature range): 70 s or more and 700 s or less.

By properly controlling the staying time within the cooling temperature range, the volume fraction of the retained austenite and the carbon concentration in the retained austenite can be properly controlled. As a result, the desired YR can be achieved. Therefore, the staying time within the cooling temperature range is set to 70 s or more. On the other hand, if the staying time within the cooling temperature range exceeds 700 s, the carbon concentration in the retained austenite increases excessively. Therefore, the hardness of martensite, which transforms from the retained austenite when the steel sheet is blanked, increases significantly. This increases the amount of voids generated during blanking and hole expanding, resulting in lower λ. In addition, the area ratio of the first hard phase decreases, making it difficult to achieve TS of 1180 MPa or more. Therefore, the staying time within the cooling temperature range is set to 70 s or more and 700 s or less. The staying time within the cooling temperature range is preferably 75 s or more, more preferably 80 s or more. The staying time within the cooling temperature range is preferably 500 s or less, more preferably 400 s or less.

Cooling conditions in the temperature range of the annealing temperature to 400° C. are not particularly limited, but for example, the average cooling rate within the temperature range is preferably 5° C./s or higher. The average cooling rate within the temperature range is preferably 30° C./s or lower.

Cooling conditions in the temperature range without exceeding 50° C. are not limited, and cooling to a desired temperature, e.g., about room temperature, by any method is sufficient.

Skin pass rolling (temper rolling) may also be applied to the cooled steel sheet. The rolling reduction in the skin pass rolling is preferably 0.05% or more from the viewpoint of preferentially increasing the yield ratio in the rolling direction. No upper limit is placed on the rolling reduction in the skin pass rolling, but from the viewpoint of productivity, 1.50% or less is preferable. The skin pass rolling may be performed on-line or off-line. Skin pass may be performed in one or more batches to achieve a target rolling reduction.

[Working Process]

Then, the cold-rolled steel sheet is worked. In this case, it is extremely important to satisfy the conditions below. The cold-rolled steel sheet to be working material in the working process includes a cold-rolled steel sheet with a coated or plated layer on the surface (hereinafter also referred to as "coated or plated steel sheet"), which is obtained when the coating or plating treatment described below is performed after the above annealing process and before the working process.

Equivalent plastic strain at position of sheet thickness×1/20 of cold-rolled steel sheet (hereinafter simply referred to as equivalent plastic strain): 0.10% or more The cold-rolled steel sheet that has undergone the above annealing and cooling can be worked to give equivalent plastic strain: 0.10% or more to increase the integration degree of {112}<111> orientation and to preferentially increase the yield ratio in the rolling direction. To achieve these effects, the equivalent plastic strain applied by working needs to be 0.10% or more. The equivalent plastic strain applied by working is preferably 0.15% or more, more preferably 0.20% or more. No upper limit is placed on the equivalent plastic strain applied by working, but from the viewpoint of productivity, the equivalent plastic strain applied by working is preferably 2.00% or less. The equivalent plastic strain applied by working is more preferably 1.50% or less.

Here, the equivalent plastic strain is calculated by the method described in "Keisuke Misaka and Ken Masui: Plasticity and Working, 17 (1976), 988" (hereinafter simply referred to as Misaka).

In this equivalent plastic strain calculation, the data input values below are used. Further, the work hardening behavior of the material shall be elastoplastic with linear hardening.

Tension reduction due to Bauschinger effect and bend loss is ignored. Furthermore, the Misaka's formula is used as the working curvature formula.

Material size: sheet thickness of 1.6 mm, width of 920 mm

Division number of sheet thickness: 31

Young's modulus: 21000 kgf/mm$^2$

Poisson's ratio: 0.3

Yield stress: 111 kgf/mm$^2$

Plasticity coefficient: 1757 kgf/mm$^2$

The above working method is not limited, and general methods are acceptable as long as they can apply a predetermined amount of strain to the steel sheet. For example, stretchers, continuous stretcher levelers, roller levelers, and tension levelers can be used. The amount of strain to be applied can be adjusted, for example, by changing the pressing amount (intermesh) and tension of leveler rollers.

Tempering treatment may be performed after the above working. Tempering after working can further reduce the retained austenite with low carbon concentration, which is a factor that lowers YS. As a result, YR can be further increased. The tempering temperature is preferably 150° C. or higher from the viewpoint of increasing YR. On the other hand, the tempering temperature is preferably 400° C. or lower because it may be difficult to achieve TS of 1180 MPa or more. When the high strength steel sheet is to be traded, it is usually cooled to room temperature before being traded.

[Coating or Plating Treatment Process]

Optionally, coating or plating treatment may also be performed on the cold-rolled steel sheet. The coating or plating treatment is preferably performed before the above working process, especially after the above annealing process and before the above working process (e.g., after the above annealing process and before staying within the cooling temperature range in the above cooling process, or after the above cooling process and before the above working process). The type of coating or plating metal is not limited, and in one example is zinc. Examples of galvanizing treatment include hot-dip galvanizing treatment and galvannealing in which alloying treatment is performed after hot-dip galvanizing treatment. Annealing and hot-dip galvanizing treatment may be performed (in one line) using equipment configured to perform annealing and hot-dip galvanizing treatment continuously. Otherwise, hot-dip zinc-aluminum-magnesium alloy coating treatment may be applied.

When hot-dip galvanizing treatment is performed, the cold-rolled steel sheet is immersed in a galvanizing bath at 440° C. or higher and 500° C. or lower for hot-dip galvanizing, after which coating weight is adjusted using gas wiping or the like. In the hot-dip galvanizing treatment, a molten bath is preferably used with an Al content of 0.10 mass % or more. A molten bath is preferably used with an Al content of 0.23 mass % or less. A molten bath with the balance being Zn and inevitable impurities is preferably used. In the galvannealing treatment, after the hot-dip galvanizing treatment, the galvanized coating is preferably subjected to alloying treatment in a temperature of 460° C. or higher. The galvanized coating is preferably subjected to alloying treatment in a temperature of 600° C. or lower. If the alloying temperature is lower than 460° C., the Zn—Fe alloying speed may be excessively slow and alloying may be difficult. On the other hand, if the alloying temperature exceeds 600° C., untransformed austenite may transform to pearlite, resulting in a decrease in TS and ductility. Therefore, in the alloying treatment of galvanized coating, the alloying treatment is preferably performed at a temperature of 460° C. or higher. The alloying treatment is preferably performed at a temperature of 600° C. or lower. The alloying treatment is more preferably performed at a temperature of 470° C. or higher. The alloying treatment is more preferably performed at a temperature of 560° C. or lower. The alloying treatment is further preferably performed at a temperature of 470° C. or higher. The alloying treatment is further preferably performed at a temperature of 530° C. or lower.

The coating or plating weight is not particularly limited, but for example, in the case of hot dip galvanizing and galvannealing treatment, the coating weight is preferably 20 g/m$^2$ or more per side (double-sided coating). The coating weight is preferably 80 g/m$^2$ or less per side (double-sided coating). The coating or plating weight can be adjusted by, for example, gas wiping after hot-dip galvanizing treatment, as described above.

The above description focuses on the cases of hot dip galvanizing and galvannealing treatment, but a plated layer such as Zn plating, Zn—Ni alloy plating, or Al plating may also be formed by electroplating treatment. In one example, the plated layer is an electrogalvanized layer. When forming the electrogalvanized layer, for example, a plating bath with a composition consisting of Ni: 9 mass % or more and 25 mass % or less with the balance being Zn and inevitable impurities can be used. It is also preferable to use a plating bath of room temperature or higher. It is also preferable to use a plating bath of 100° C. or lower. In the case of electroplating treatment, the plating weight is preferably 15 g/m$^2$ or more per side (double-sided plating). The plating weight is preferably 100 g/m$^2$ or less per side (double-sided plating).

Skin pass rolling may be performed after the coating or plating treatment. The rolling reduction in the skin pass rolling is preferably 0.05% or more from the viewpoint of preferentially increasing the yield ratio in the rolling direction. No upper limit is placed on the rolling reduction in the skin pass rolling, but from the viewpoint of productivity, 1.50% or less is preferable. The skin pass rolling may be performed on-line or off-line. Skin pass may be performed in one or more batches to achieve a target rolling reduction.

Other manufacturing conditions are not limited. When hot-dip galvanizing and galvannealing treatment are used as the coating or plating treatment, from the viewpoint of productivity, a series of processes such as annealing, cooling, hot-dip galvanizing, and alloying treatment are preferably performed in a continuous galvanizing line (CGL), which is a hot dip galvanizing line. After the hot-dip galvanizing treatment, wiping can be performed for adjusting the coating amounts.

Conditions of the coating or plating treatment other than the above and may be in accordance with conventional methods for each coating or plating treatment. In addition, when the high strength steel sheet after coating or plating treatment is to be traded, it is usually cooled to room temperature before being traded.

Manufacturing conditions other than the above are not limited, and may be in accordance with conventional methods.

[3] Member

Next, a member according to one of the disclosed embodiments is described.

The member according to one of the disclosed embodiments is a member made of the high strength steel sheet according to one of the disclosed embodiments described above. The member according to one of the disclosed embodiments is, for example, the high strength steel sheet according to one of the disclosed embodiments formed into a desired shape by press working or other means. The member according to one of the disclosed embodiments is suitably for automotive frame structural components or for automotive reinforcing components.

Here, the high strength steel sheet according to one of the disclosed embodiments is a high strength steel sheet having high stretch flangeability and high YR in the rolling direction as well as in the direction orthogonal to the rolling direction with TS of 1180 MPa or more. Therefore, the member according to one of the disclosed embodiments can contribute to weight reduction of the automotive body and can be suitably used especially for automotive frame structural components or for automotive reinforcing components in general.

EXAMPLES

Steel slabs (steel materials) having the chemical composition listed in Table 1 with the balance being Fe and inevitable impurities were prepared using a converter. The steel slabs were obtained by continuous casting. The resulting steel slabs were heated to 1250° C. and subjected to rough rolling to obtain sheet bars. The resulting sheet bars were then subjected to finish rolling at a rolling finish temperature of 900° C. and coiled at a coiling temperature of 450° C. to obtain hot-rolled steel sheets. The resulting hot-rolled steel sheets were subjected to pickling and then cold rolled under the conditions listed in Table 2 to obtain cold-rolled steel sheets with a thickness of 1.4 mm.

The resulting cold-rolled steel sheets were then annealed, cooled, and worked under the conditions listed in Table 2. Some of the steel sheets were coated or plated (with coated or plated layer on both sides) by applying the types of coating or plating treatment listed in Table 2 after annealing and before working under the conditions listed in Table 2. In the types of coating or plating treatment in Table 2, CR means no coating or plating (cold-rolled steel sheet as is), GI means hot-dip galvanizing treatment (hot dip galvanized steel sheet was obtained), GA means galvannealing treatment (galvannealed steel sheet was obtained), and EG means electrogalvanized plating (electrogalvanized (Zn—Ni alloy plated) steel sheet was obtained).

In the GI, a hot-dip galvanizing bath having Al: 0.14 mass % to 0.19 mass % with the balance being Zn and inevitable impurities was used as the molten bath. In GA, a hot-dip galvanizing bath having Al: 0.14 mass % with the balance being Zn and inevitable impurities was used as the molten bath. The molten bath temperature was 470° C. for both cases. The coating weight was about 45 g/m$^2$ to 72 g/m$^2$ per side for GI and about 45 g/m$^2$ per side for GA. In GA, the Fe concentration in the coated layer was 9 mass % or more and 12 mass % or less. In EG, the plated layer was a Zn—Ni alloy plated layer, and the Ni content in the plated layer was 9 mass % or more and 25 mass % or less. For conditions not specified, the conventional method was followed.

The steel sheets thus obtained were measured by the method described above for the area ratio of the first hard phase, second hard phase, and ferrite phase, the average grain size of the first hard phase and second hard phase, the volume fraction-carbon concentration ratio of the retained austenite, and the integration degree of {112}<111> orientation. The results are provided in Table 3. The chemical compositions of base steel sheets of the obtained steel sheets were virtually the same as those of the steel slabs, and the chemical compositions of all of the conforming steels were within the range of the chemical composition according to the above mentioned embodiment, while the chemical compositions of all of the comparative steels were outside the range of the chemical composition according to the above mentioned embodiment. In each obtained steel sheet, the volume fraction of retained austenite in the residual microstructure other than the first hard phase, second hard phase, and ferrite phase was 5% or less and the area ratio of the microstructure other than retained austenite was 5% or less.

The obtained steel sheets were evaluated for tensile properties and stretch flangeability according to the test method below. The results are also listed in Table 3.

[Tensile Test]

Tensile test was performed in accordance with JIS Z 2241. From each of the obtained steel sheets, JIS No. 5 test pieces were taken so that the rolling direction (L-direction) and the direction orthogonal to the rolling direction (C-direction) of the steel sheet were the longitudinal direction. The collected test pieces were then subjected to tensile test at a crosshead speed of $1.67\times10^{-1}$ mm/s to measure YS and TS in the rolling direction (L direction) and direction orthogonal to the rolling direction (C direction). Further, when TS was 1180 MPa or more both in the rolling direction (L direction) and direction orthogonal to the rolling direction (C direction), TS was judged as "passed". From the measured YS and TS in the rolling direction (L direction) and direction orthogonal to the rolling direction (C direction), YR in each of the rolling direction (L direction) and direction orthogonal to the rolling direction (C direction) was calculated using the above formula (1). When YR was 70% or more both in the rolling direction and direction orthogonal to the rolling direction, YR was judged as "passed".

[Hole Expanding Test]

Hole expanding test was performed in accordance with JIS Z 2256. Each of the resulting steel sheets was sheared to 100 mm×100 mm, and then a hole with a diameter of 10 mm was punched through the sheared steel sheet with a clearance of 12.5%. Then, the steel sheet was clamped into a die having an inner diameter of 75 mm with a blank holding force of 9 tons (88.26 kN). In this state, a conical punch with a top angle of 60° was pushed into the hole and the hole diameter at the crack initiation limit was measured. The following formula was then used to determine (marginal) hole expansion ratio: λ (%).

$$\text{(Limit) hole expansion ratio: } \lambda(\%) = \{(D_f - D_0)/D_0\} \times 100$$

where $D_f$ is a hole diameter at crack initiation (mm) and $D_0$ is an initial hole diameter (mm). Then, stretch flangeability was judged as "passed" when (limit) hole expansion ratio: λ was 30% or more.

TABLE 1

| Steel | Chemical Composition (mass %) | | | | | | | | | | | | | | |
|---|---|---|---|---|---|---|---|---|---|---|---|---|---|---|---|
| sample ID | C | Si | Mn | P | S | Al | N | O | Ti | Nb | V | Ta | W | B | Cr |
| A | 0.173 | 1.09 | 2.90 | 0.029 | 0.0008 | 0.042 | 0.0044 | — | — | — | — | — | — | — | — |
| B | 0.227 | 0.30 | 2.89 | 0.049 | 0.0047 | 0.039 | 0.0028 | — | — | — | — | — | — | — | — |

TABLE 1-continued

| | | | | | | | | | | | | | | | |
|---|---|---|---|---|---|---|---|---|---|---|---|---|---|---|---|
| C | 0.105 | 0.71 | 3.16 | 0.013 | 0.0020 | 0.026 | 0.0032 | — | — | — | — | — | — | — | — |
| D | 0.352 | 1.17 | 3.08 | 0.010 | 0.0006 | 0.034 | 0.0028 | — | — | — | — | — | — | — | — |
| E | 0.292 | 0.83 | 3.14 | 0.004 | 0.0007 | 0.045 | 0.0030 | — | — | — | — | — | — | — | — |
| F | 0.082 | 1.10 | 3.00 | 0.038 | 0.0018 | 0.039 | 0.0030 | — | — | — | — | — | — | — | — |
| G | 0.107 | 2.66 | 3.00 | 0.045 | 0.0015 | 0.037 | 0.0033 | — | — | — | — | — | — | — | — |
| H | 0.120 | 0.94 | 1.95 | 0.020 | 0.0028 | 0.040 | 0.0037 | — | — | — | — | — | — | — | — |
| I | 0.114 | 1.02 | 4.12 | 0.010 | 0.0047 | 0.025 | 0.0025 | — | — | — | — | — | — | — | — |
| J | 0.182 | 0.61 | 2.95 | 0.011 | 0.0027 | 0.033 | 0.0039 | 0.0009 | 0.035 | — | — | — | — | — | — |
| K | 0.152 | 1.07 | 3.19 | 0.047 | 0.0014 | 0.040 | 0.0037 | — | — | 0.022 | — | — | — | — | — |
| L | 0.214 | 0.88 | 2.97 | 0.040 | 0.0025 | 0.049 | 0.0031 | — | — | — | 0.018 | — | — | — | — |
| M | 0.173 | 0.99 | 2.60 | 0.013 | 0.0021 | 0.027 | 0.0046 | — | — | — | — | 0.030 | 0.02 | — | — |
| N | 0.295 | 1.05 | 3.08 | 0.040 | 0.0023 | 0.046 | 0.0034 | — | — | 0.034 | — | 0.020 | — | — | — |
| O | 0.211 | 1.32 | 3.07 | 0.010 | 0.0020 | 0.033 | 0.0047 | — | 0.019 | — | — | — | — | 0.0025 | — |
| P | 0.235 | 1.12 | 2.90 | 0.009 | 0.0016 | 0.023 | 0.0036 | — | — | — | — | — | — | — | 0.31 |
| Q | 0.211 | 0.83 | 3.55 | 0.039 | 0.0011 | 0.037 | 0.0030 | — | — | — | — | — | — | — | — |
| R | 0.281 | 0.55 | 2.88 | 0.041 | 0.0001 | 0.030 | 0.0035 | — | — | — | — | — | — | — | — |
| S | 0.213 | 0.56 | 2.89 | 0.014 | 0.0023 | 0.030 | 0.0039 | — | — | — | — | — | — | — | — |
| T | 0.181 | 0.84 | 3.17 | 0.003 | 0.0040 | 0.038 | 0.0043 | — | — | — | — | — | — | — | — |
| U | 0.153 | 1.06 | 2.98 | 0.007 | 0.0017 | 0.022 | 0.0031 | — | — | — | — | — | — | — | — |
| V | 0.343 | 0.75 | 3.05 | 0.007 | 0.0016 | 0.049 | 0.0037 | — | — | — | — | — | — | — | — |
| W | 0.209 | 0.93 | 3.01 | 0.007 | 0.0027 | 0.031 | 0.0028 | — | — | — | — | — | — | — | — |
| X | 0.180 | 0.93 | 2.97 | 0.030 | 0.0043 | 0.028 | 0.0031 | — | — | — | — | — | — | — | — |
| Y | 0.101 | 0.89 | 3.17 | 0.046 | 0.0018 | 0.038 | 0.0026 | — | — | — | — | — | — | — | — |
| Z | 0.206 | 0.59 | 3.13 | 0.008 | 0.0047 | 0.047 | 0.0040 | — | — | — | — | — | — | — | — |
| a | 0.209 | 0.40 | 2.65 | 0.008 | 0.0009 | 0.021 | 0.0045 | — | 0.025 | 0.008 | — | — | — | 0.0017 | — |
| b | 0.195 | 1.50 | 2.79 | 0.007 | 0.0046 | 0.021 | 0.0043 | — | — | — | — | — | — | — | — |
| c | 0.212 | 0.20 | 2.20 | 0.011 | 0.0014 | 0.040 | 0.0038 | — | — | — | — | — | — | — | — |
| d | 0.190 | 0.60 | 3.80 | 0.005 | 0.0044 | 0.046 | 0.0049 | — | — | — | — | — | — | — | — |

| Steel | Chemical Composition (mass %) | | | | | | | | | | | | | |
|---|---|---|---|---|---|---|---|---|---|---|---|---|---|---|
| sample ID | Mo | Ni | Co | Cu | Sn | Sb | Ca | Mg | REM | Zr | Te | Hf | Bi | Remarks |
| A | — | — | — | — | — | — | — | — | — | — | — | — | — | Conforming Steel |
| B | — | — | — | — | — | — | — | — | — | — | — | — | — | Conforming Steel |
| C | — | — | — | — | — | — | — | — | — | — | — | — | — | Conforming Steel |
| D | — | — | — | — | — | — | — | — | — | — | — | — | — | Conforming Steel |
| E | — | — | — | — | — | — | — | — | — | — | — | — | — | Conforming Steel |
| F | — | — | — | — | — | — | — | — | — | — | — | — | — | Comparative Steel |
| G | — | — | — | — | — | — | — | — | — | — | — | — | — | Comparative Steel |
| H | — | — | — | — | — | — | — | — | — | — | — | — | — | Comparative Steel |
| I | — | — | — | — | — | — | — | — | — | — | — | — | — | Comparative Steel |
| J | — | — | — | — | — | — | — | — | — | — | — | — | — | Conforming Steel |
| K | — | — | — | — | — | — | — | — | — | — | — | — | — | Conforming Steel |
| L | — | — | — | — | — | — | — | — | — | — | — | — | — | Conforming Steel |
| M | — | — | — | — | — | — | — | — | — | — | — | — | — | Conforming Steel |
| N | — | — | — | — | — | — | — | — | — | — | — | — | — | Conforming Steel |
| O | — | — | — | — | — | — | — | — | — | — | — | — | — | Conforming Steel |
| P | — | — | — | — | — | — | — | — | — | — | — | — | — | Conforming Steel |
| Q | 0.07 | — | — | — | — | — | — | — | — | — | — | — | — | Conforming Steel |
| R | — | 0.11 | — | — | — | — | — | — | — | — | — | — | — | Conforming Steel |
| S | — | — | 0.005 | — | — | — | — | — | — | — | — | — | — | Conforming Steel |
| T | — | — | — | 0.08 | — | — | — | — | — | — | — | — | — | Conforming Steel |
| U | — | — | — | — | 0.012 | — | — | — | — | — | — | — | — | Conforming Steel |

TABLE 1-continued

| | | | | | | | | | | | | | | |
|---|---|---|---|---|---|---|---|---|---|---|---|---|---|---|
| V | — | — | — | — | — | 0.009 | — | — | — | — | — | — | — | Conforming Steel |
| W | — | — | — | — | — | — | 0.0002 | — | — | — | — | — | — | Conforming Steel |
| X | — | — | — | — | — | — | — | 0.0011 | 0.0019 | — | — | — | — | Conforming Steel |
| Y | — | — | — | — | — | — | — | — | — | 0.034 | — | — | — | Conforming Steel |
| Z | — | — | — | — | — | — | — | — | — | — | 0.003 | 0.03 | 0.002 | Conforming Steel |
| a | — | — | — | — | — | — | — | — | — | — | — | — | — | Conforming Steel |
| b | — | — | — | — | — | — | — | — | — | — | — | — | — | Conforming Steel |
| c | — | — | — | — | — | — | — | — | — | — | — | — | — | Conforming Steel |
| d | — | — | — | — | — | — | — | — | — | — | — | — | — | Conforming Steel |

Underlined if outside the scope of the disclosure.

TABLE 2

| | | Cold Rolling Conditions | | Annealing Conditions | | Cooling | | | |
|---|---|---|---|---|---|---|---|---|---|
| No. | Steel sample ID | Numper of passes (times) | Accumulated rolling reduction ratio (%) | Average heating rate within heating temperature range (° C./s) | Annealing temperature (° C.) | Conditions Staying time in cooling temperature range (s) | Working Conditions Equivalent plastic strain (%) | Coating or Plating Conditions Type | Remarks |
| 1 | A | 3 | 35 | 20 | 880 | 110 | 0.70 | CR | Example |
| 2 | B | 2 | 45 | 40 | 910 | 115 | 1.00 | GA | Example |
| 3 | C | 5 | 40 | 20 | 890 | 110 | 0.20 | GA | Example |
| 4 | C | 1 | 40 | 20 | 890 | 110 | 0.50 | GA | Comparative Example |
| 5 | C | 5 | 15 | 20 | 890 | 110 | 0.50 | GA | Comparative Example |
| 6 | C | 5 | 85 | 20 | 890 | 110 | 0.50 | GA | Comparative Example |
| 7 | C | 5 | 40 | 7 | 890 | 110 | 0.50 | GA | Comparative Example |
| 8 | C | 5 | 40 | 20 | 750 | 110 | 0.50 | GA | Comparative Example |
| 9 | C | 5 | 40 | 20 | 1000 | 110 | 0.50 | GA | Comparative Example |
| 10 | C | 5 | 40 | 20 | 890 | 55 | 0.50 | GA | Comparative Example |
| 11 | C | 5 | 40 | 20 | 890 | 1000 | 0.50 | GA | Comparative Example |
| 12 | C | 5 | 40 | 20 | 890 | 110 | 0.05 | GA | Comparative Example |
| 13 | D | 7 | 50 | 18 | 820 | 120 | 0.35 | CR | Example |
| 14 | E | 6 | 30 | 10 | 910 | 215 | 1.20 | GA | Example |
| 15 | F | 4 | 45 | 18 | 900 | 125 | 0.80 | GI | Comparative Example |
| 16 | G | 4 | 45 | 18 | 900 | 125 | 0.80 | GA | Comparative Example |
| 17 | H | 4 | 45 | 18 | 900 | 125 | 0.80 | GA | Comparative Example |
| 18 | I | 4 | 45 | 18 | 900 | 125 | 0.80 | GA | Comparative Example |
| 19 | J | 5 | 55 | 12 | 890 | 190 | 0.40 | GA | Example |
| 20 | K | 8 | 60 | 17 | 910 | 130 | 0.20 | CR | Example |
| 21 | L | 5 | 60 | 48 | 900 | 80 | 0.20 | GA | Example |
| 22 | M | 5 | 45 | 16 | 890 | 135 | 0.20 | EG | Example |
| 23 | N | 4 | 45 | 23 | 840 | 95 | 0.15 | GA | Example |
| 24 | O | 9 | 45 | 16 | 940 | 140 | 1.20 | GA | Example |
| 25 | P | 10 | 40 | 24 | 890 | 90 | 0.35 | GA | Example |
| 26 | Q | 7 | 40 | 15 | 900 | 150 | 1.00 | GA | Example |
| 27 | R | 5 | 35 | 14 | 920 | 650 | 0.20 | GA | Example |
| 28 | S | 6 | 27 | 14 | 870 | 155 | 0.20 | GA | Example |
| 29 | T | 4 | 50 | 25 | 910 | 85 | 0.10 | GA | Example |
| 30 | U | 7 | 50 | 14 | 930 | 320 | 1.00 | CR | Example |
| 31 | V | 8 | 60 | 26 | 890 | 85 | 1.50 | CR | Example |

TABLE 2-continued

| No. | Steel sample ID | Cold Rolling Conditions: Numper of passes (times) | Cold Rolling Conditions: Accumulated rolling reduction ratio (%) | Annealing Conditions: Average heating rate within heating temperature range (° C./s) | Annealing Conditions: Annealing temperature (° C.) | Cooling Conditions: Staying time in cooling temperature range (s) | Working Conditions: Equivalent plastic strain (%) | Coating or Plating Conditions: Type | Remarks |
|---|---|---|---|---|---|---|---|---|---|
| 32 | W | 6 | 60 | 31 | 920 | 75 | 1.00 | GA | Example |
| 33 | X | 5 | 55 | 27 | 890 | 85 | 0.50 | GA | Example |
| 34 | Y | 4 | 65 | 34 | 900 | 180 | 0.50 | GI | Example |
| 35 | Z | 5 | 50 | 27 | 870 | 460 | 1.00 | GA | Example |
| 36 | a | 5 | 50 | 27 | 900 | 110 | 1.00 | GA | Example |
| 37 | b | 5 | 50 | 27 | 900 | 110 | 1.00 | GA | Example |
| 38 | c | 5 | 50 | 27 | 900 | 110 | 1.00 | GA | Example |
| 39 | d | 5 | 50 | 27 | 900 | 110 | 1.00 | GA | Example |

Underlined if outside the scope of the disclosure.

TABLE 3

| No. | Steel sample ID | Steel Microstructure: Area ratio: First hard phase (%) | Area ratio: Second hard phase (%) | Area ratio: α (%) | Residual microstructure | Average grain size of hard phase (μm) | Volume fraction - carbon concentration ratio of retained austenite (γ) | Integration degree of {112}<111> orientation |
|---|---|---|---|---|---|---|---|---|
| 1 | A | 73 | 20 | 0 | Retained γ, θ | 3.3 | 0.17 | 1.2 |
| 2 | B | 80 | 11 | 3 | Retained γ, θ | 4.5 | 0.13 | 1.9 |
| 3 | C | 60 | 33 | 0 | Retained γ, θ | 3.3 | 0.16 | 2.6 |
| 4 | C | 64 | 26 | 4 | Retained γ, θ | 6.4 | 0.20 | 0.9 |
| 5 | C | 57 | 26 | 11 | Retained γ, θ | 4.2 | 0.13 | 2.8 |
| 6 | C | 61 | 32 | 0 | Retained γ, θ | 2.7 | 0.09 | 1.5 |
| 7 | C | 57 | 29 | 8 | Retained γ, θ | 6.2 | 0.19 | 1.8 |
| 8 | C | 57 | 25 | 12 | Retained γ, θ | 2.2 | 0.21 | 3.5 |
| 9 | C | 62 | 27 | 3 | Retained γ, θ | 7.9 | 0.42 | 1.5 |
| 10 | C | 60 | 34 | 1 | Retained γ, θ | 2.8 | 0.05 | 1.5 |
| 11 | C | 52 | 38 | 3 | Retained γ, θ | 2.3 | 0.48 | 2.4 |
| 12 | C | 60 | 33 | 0 | Retained γ, θ | 4.9 | 0.12 | 0.8 |
| 13 | D | 81 | 10 | 2 | Retained γ, θ | 4.9 | 0.24 | 2.6 |
| 14 | E | 79 | 11 | 4 | Retained γ, θ | 4.3 | 0.17 | 2.1 |
| 15 | F | 48 | 40 | 6 | Retained γ, θ | 3.7 | 0.16 | 3.3 |
| 16 | G | 58 | 35 | 1 | Retained γ, θ | 4.7 | 0.49 | 1.2 |
| 17 | H | 45 | 37 | 12 | Retained γ, θ | 2.9 | 0.39 | 1.2 |
| 18 | I | 91 | 3 | 0 | Retained γ, θ | 3.4 | 0.24 | 2.6 |
| 19 | J | 75 | 18 | 0 | Retained γ, θ | 4.0 | 0.15 | 2.4 |
| 20 | K | 65 | 26 | 3 | Retained γ, θ | 3.6 | 0.15 | 2.1 |
| 21 | L | 73 | 19 | 2 | Retained γ, θ | 3.6 | 0.12 | 1.5 |
| 22 | M | 66 | 23 | 4 | Retained γ, θ | 4.1 | 0.10 | 1.9 |
| 23 | N | 80 | 14 | 0 | Retained γ, θ | 3.8 | 0.28 | 1.3 |
| 24 | O | 74 | 19 | 1 | Retained γ, θ | 4.6 | 0.31 | 1.2 |
| 25 | P | 76 | 15 | 3 | Retained γ, θ | 3.5 | 0.26 | 1.7 |
| 26 | Q | 78 | 15 | 0 | Retained γ, θ | 2.4 | 0.29 | 1.6 |
| 27 | R | 77 | 15 | 2 | Retained γ, θ | 4.1 | 0.45 | 2.3 |
| 28 | S | 71 | 16 | 7 | Retained γ, θ | 4.6 | 0.18 | 2.0 |
| 29 | T | 72 | 16 | 6 | Retained γ, θ | 3.6 | 0.17 | 1.6 |
| 30 | U | 65 | 29 | 0 | Retained γ, θ | 2.3 | 0.18 | 1.9 |
| 31 | V | 84 | 9 | 0 | Retained γ, θ | 2.4 | 0.24 | 2.4 |
| 32 | W | 76 | 18 | 0 | Retained γ, θ | 4.2 | 0.11 | 1.2 |
| 33 | X | 74 | 16 | 3 | Retained γ, θ | 3.0 | 0.30 | 1.6 |
| 34 | Y | 62 | 31 | 0 | Retained γ, θ | 4.0 | 0.15 | 1.9 |

TABLE 3-continued

| | | | | | | | | |
|---|---|---|---|---|---|---|---|---|
| 35 | Z | 73 | 19 | 1 | Retained γ, θ | 3.7 | 0.41 | 2.1 |
| 36 | a | 77 | 14 | 4 | Retained γ, θ | 3.1 | 0.23 | 2.1 |
| 37 | b | 74 | 15 | 9 | Retained γ, θ | 3.2 | 0.18 | 2.8 |
| 38 | c | 74 | 19 | 0 | Retained γ, θ | 3.5 | 0.28 | 1.6 |
| 39 | d | 77 | 19 | 3 | Retained γ, θ | 4.1 | 0.19 | 3.1 |

| | Mechanical Properties | | | | | | | |
|---|---|---|---|---|---|---|---|---|
| | Direction orthogonal to rolling direction | | | Rolling direction | | | | |
| No. | YS (MPa) | TS (MPa) | YR (%) | YS (MPa) | TS (MPa) | YR (%) | λ (%) | Remarks |
| 1 | 1238 | 1548 | 80 | 1281 | 1473 | 87 | 64 | Example |
| 2 | 1431 | 1834 | 78 | 1474 | 1863 | 79 | 37 | Example |
| 3 | 956 | 1258 | 76 | 981 | 1233 | 80 | 47 | Example |
| 4 | 806 | 1221 | 66 | 794 | 1200 | 66 | 32 | Comparative Example |
| 5 | 760 | 1206 | 63 | 795 | 1245 | 64 | 56 | Comparative Example |
| 6 | 792 | 1218 | 65 | 844 | 1184 | 71 | 47 | Comparative Example |
| 7 | 815 | 1273 | 64 | 877 | 1203 | 73 | 54 | Comparative Example |
| 8 | 793 | 1220 | 65 | 864 | 1253 | 69 | 59 | Comparative Example |
| 9 | 764 | 1253 | 61 | 810 | 1181 | 69 | 52 | Comparative Example |
| 10 | 709 | 1181 | 60 | 727 | 1207 | 60 | 32 | Comparative Example |
| 11 | 885 | 1135 | 78 | 1018 | 1138 | 89 | 10 | Comparative Example |
| 12 | 876 | 1252 | 70 | 816 | 1232 | 66 | 32 | Comparative Example |
| 13 | 1559 | 2051 | 76 | 1601 | 2028 | 79 | 47 | Example |
| 14 | 1470 | 1861 | 79 | 1507 | 1834 | 82 | 44 | Example |
| 15 | 846 | 1113 | 76 | 885 | 1121 | 79 | 56 | Comparative Example |
| 16 | 921 | 1261 | 73 | 933 | 1271 | 73 | 10 | Comparative Example |
| 17 | 703 | 1116 | 63 | 759 | 1129 | 67 | 50 | Comparative Example |
| 18 | 964 | 1252 | 77 | 1001 | 1266 | 79 | 24 | Comparative Example |
| 19 | 1091 | 1495 | 73 | 1109 | 1507 | 74 | 55 | Example |
| 20 | 1007 | 1342 | 75 | 1067 | 1397 | 76 | 64 | Example |
| 21 | 1232 | 1579 | 78 | 1273 | 1568 | 81 | 41 | Example |
| 22 | 1131 | 1346 | 84 | 1196 | 1343 | 89 | 60 | Example |
| 23 | 1318 | 1806 | 73 | 1355 | 1848 | 73 | 65 | Example |
| 24 | 1066 | 1481 | 72 | 1122 | 1551 | 72 | 47 | Example |
| 25 | 1460 | 1802 | 81 | 1498 | 1797 | 83 | 36 | Example |
| 26 | 1320 | 1784 | 74 | 1398 | 1858 | 75 | 38 | Example |
| 27 | 1364 | 1869 | 73 | 1372 | 1838 | 75 | 49 | Example |
| 28 | 1225 | 1494 | 82 | 1293 | 1470 | 88 | 58 | Example |
| 29 | 1160 | 1506 | 77 | 1234 | 1595 | 77 | 38 | Example |
| 30 | 1090 | 1380 | 79 | 1137 | 1340 | 85 | 65 | Example |
| 31 | 1636 | 2020 | 81 | 1704 | 1969 | 87 | 30 | Example |
| 32 | 1247 | 1599 | 78 | 1311 | 1586 | 83 | 63 | Example |
| 33 | 1277 | 1538 | 83 | 1338 | 1527 | 88 | 57 | Example |
| 34 | 956 | 1210 | 79 | 1008 | 1244 | 81 | 53 | Example |
| 35 | 1059 | 1492 | 71 | 1075 | 1500 | 72 | 46 | Example |
| 36 | 1110 | 1521 | 73 | 1132 | 1535 | 74 | 35 | Example |
| 37 | 1075 | 1535 | 70 | 1111 | 1552 | 72 | 31 | Example |
| 38 | 1171 | 1521 | 77 | 1204 | 1530 | 79 | 59 | Example |
| 39 | 1146 | 1548 | 74 | 1163 | 1550 | 75 | 37 | Example |

Underlined if outside the scope of the disclosure.
α: ferrite phase
Retained γ: Retained austenite
θ: cementite and/or metastable carbide As listed in Table 3, all Examples had TS of 1180 MPa or more both in the rolling direction and direction orthogonal to the rolling direction, YR of 70% or more both in the rolling direction and direction orthogonal to the rolling direction, and high stretch flangeability.

On the other hand, in the comparative examples, at least one of TS in the rolling direction and direction orthogonal to the rolling direction, YR in the rolling direction and direction orthogonal to the rolling direction, and stretch flangeability was not sufficient.

Although some embodiments of the disclosure have been described above, this disclosure is not limited by the description that forms part of the disclosure in relation to the embodiments. That is, a person skilled in the art may make other embodiments, examples, and operation techniques based on the disclosed embodiments, which will all fall within the scope of the disclosure. For example, in the series of heat treatment processes in the manufacturing method described above, any apparatus or the like may be used to perform heat treatment on the steel sheet as long as the thermal hysteresis conditions are met.

INDUSTRIAL APPLICABILITY

According to this disclosure, a high strength steel sheet with high stretch flangeability and high YR in the rolling direction as well as in the direction orthogonal to the rolling direction with TS of 1180 MPa or more can be obtained.

In particular, the high strength steel sheet of this disclosure has high YR in the rolling direction as well as high YR in the direction orthogonal to the rolling direction, making it possible to apply it to various sizes and shapes of automotive frame structural components while obtaining high component strength. This will improve fuel efficiency by reducing automotive body weight, which has tremendous industrial application value.

The invention claimed is:

1. A high strength steel sheet comprising a chemical composition containing, in mass %, C: 0.090% or more and 0.390% or less,
Si: 0.01% or more and 0.61% or less,
Mn: 2.00% or more and 4.00% or less,
P: 0.100% or less,
S: 0.0200% or less,
Al: 0.100% or less and
N: 0.0100% or less, with the balance being Fe and inevitable impurities, wherein the high strength steel sheet has a steel microstructure in which an area ratio of a first hard phase is 55% or more, an area ratio of a second hard phase is 5% or more and 40% or less, an area ratio of a ferrite phase is less than 10%, the first hard phase and second hard phase have crystal grains with an average grain size of 5.3 μm or less, a ratio of carbon concentration in retained austenite to the volume fraction of the retained austenite is 0.10 or more and 0.45 or less, and an integration degree of the {112}<111> orientation is 1.0 or more, and the high strength steel sheet has a tensile strength of 1180 MPa or more, where the first hard phase is an area having a carbon concentration of more than 0.7×[% C] and less than 1.5×[% C], which is measured by an electron probe microanalyzer at a position of a sheet thickness×¼, the second hard phase is an area having a carbon concentration of 0.05 or more and 0.7×[% C] or less, which is measured by the electron probe microanalyzer at the position of the sheet thickness×¼, the ferrite phase is an area having a carbon concentration of less than 0.05, which is measured by the electron probe microanalyzer at the position of the sheet thickness×¼, and the [% C] is a content in mass % of C in the chemical composition.

2. The high strength steel sheet according to claim 1, wherein the chemical composition further contains, in mass %, at least one selected from the group consisting of O: 0.0100% or less,
Ti: 0.200% or less,
Nb: 0.200% or less,
V: 0.200% or less,
Ta: 0.10% or less,
W: 0.10% or less,
B: 0.0100% or less,
Cr: 1.00% or less,
Mo: 1.00% or less,
Ni: 1.00% or less,
Co: 0.010% or less,
Cu: 1.00% or less,
Sn: 0.200% or less,
Sb: 0.200% or less,
Ca: 0.0100% or less,
Mg: 0.0100% or less,
REM: 0.0100% or less,
Zr: 0.100% or less,
Te: 0.100% or less,
Hf: 0.10% or less and
Bi: 0.200% or less.

3. The high strength steel sheet according to claim 1, comprising a coated or plated layer at a surface thereof.

4. The high strength steel sheet according to claim 2, comprising a coated or plated layer at a surface thereof.

5. A method for manufacturing the high strength steel sheet according to claim 1, comprising hot rolling a steel slab having the chemical composition according to claim 1 to obtain a hot-rolled steel sheet, then, subjecting the hot-rolled steel sheet to pickling, then, cold rolling the hot-rolled steel sheet with the number of passes of two or more and an accumulated rolling reduction ratio of 20% or more and 75% or less to obtain a cold-rolled steel sheet, then, subjecting the cold-rolled steel sheet to annealing with an average heating rate of 10° C./s or more within a temperature range of 250° C. to 700° C. and an annealing temperature of 820° C. or higher and 950° C. or lower, then, cooling the cold-rolled steel sheet with a staying time of 70 s or more and 700 s or less within a temperature range of 50° C. to 400° C., then, working the cold-rolled steel sheet to give an equivalent plastic strain of 0.10% or more at a position of a sheet thickness×1/20 of the cold-rolled steel sheet.

6. The method for manufacturing a high strength steel sheet according to claim 5, comprising subjecting the cold-rolled steel sheet to coating or plating treatment.

7. A method for manufacturing the high strength steel sheet according to claim 2, comprising hot rolling a steel slab having the chemical composition according to claim 2 to obtain a hot-rolled steel sheet, then, subjecting the hot-rolled steel sheet to pickling, then, cold rolling the hot-rolled steel sheet with the number of passes of two or more and an accumulated rolling reduction ratio of 20% or more and 75% or less to obtain a cold-rolled steel sheet, then, subjecting the cold-rolled steel sheet to annealing with an average heating rate of 10° C./s or more within a temperature range of 250° C. to 700° C. and an annealing temperature of 820° C. or higher and 950° C. or lower, then, cooling the cold-rolled steel sheet with a staying time of 70 s or more and 700 s or less within a temperature range of 50° C. to 400° C., then, working the cold-rolled steel sheet to give an equivalent plastic strain of 0.10% or more at a position of a sheet thickness×1/20 of the cold-rolled steel sheet.

8. The method for manufacturing a high strength steel sheet according to claim 7, comprising subjecting the cold-rolled steel sheet to coating or plating treatment.

9. A member made of the high strength steel sheet according to claim 1.

10. The member according to claim 9 for automotive frame structural components or for automotive reinforcing components.

11. A member made of the high strength steel sheet according to claim 2.

12. The member according to claim 11 for automotive frame structural components or for automotive reinforcing components.

13. A member made of the high strength steel sheet according to claim 3.

14. The member according to claim 13 for automotive frame structural components or for automotive reinforcing components.

15. A member made of the high strength steel sheet according to claim 4.

16. The member according to claim 15 for automotive frame structural components or for automotive reinforcing components.

* * * * *